US008192331B2

(12) United States Patent
Colombo et al.

(10) Patent No.: US 8,192,331 B2
(45) Date of Patent: Jun. 5, 2012

(54) DEVICE FOR ADJUSTING THE PRESTRESS OF AN ELASTIC MEANS AROUND A PREDETERMINED TENSION OR POSITION

(75) Inventors: Gery Colombo, Uster (CH); Rainer Bucher, Wettswil a.A. (CH)

(73) Assignee: Hocoma AG, Volketswil (CH)

( * ) Notice: Subject to any disclaimer, the term of this patent is extended or adjusted under 35 U.S.C. 154(b) by 341 days.

(21) Appl. No.: 12/443,954

(22) PCT Filed: Oct. 5, 2007

(86) PCT No.: PCT/EP2007/008652

§ 371 (c)(1),
(2), (4) Date: Jun. 12, 2009

(87) PCT Pub. No.: WO2008/040554

PCT Pub. Date: Apr. 10, 2008

(65) Prior Publication Data

US 2010/0006737 A1 Jan. 14, 2010

(30) Foreign Application Priority Data

Oct. 5, 2006 (EP) ..... 06121857

(51) Int. Cl.
*A63B 23/04* (2006.01)

(52) U.S. Cl. ..... 482/69; 248/575

(58) Field of Classification Search ..... 248/571, 248/579, 605, 562, 576, 575, 618; 482/69, 482/54, 51, 66, 121–130; 5/83.1; 254/334–338; 211/209

See application file for complete search history.

(56) References Cited

U.S. PATENT DOCUMENTS

| | | | | |
|---|---|---|---|---|
| 5,273,502 | A | 12/1993 | Kelsey et al. | |
| 5,695,432 | A * | 12/1997 | Soderlund | 482/69 |
| 5,704,881 | A | 1/1998 | Dudley | |
| 6,273,844 | B1 * | 8/2001 | Kelsey et al. | 482/54 |
| 6,302,828 | B1 * | 10/2001 | Martin et al. | 482/69 |
| 2006/0052728 | A1 | 3/2006 | Kerrigan et al. | |

FOREIGN PATENT DOCUMENTS

| | | |
|---|---|---|
| EP | 1 137 378 | 5/2000 |
| EP | 1 586 291 A1 | 10/2005 |

* cited by examiner

*Primary Examiner* — Terrell McKinnon
*Assistant Examiner* — Ingrid M Weinhold
(74) *Attorney, Agent, or Firm* — The Webb Law Firm

(57) ABSTRACT

A device for adjusting the prestress of an elastic means around a predetermined tension or position can especially be used to adjust the height of and the relief force acting on a weight. A mechanic adjustment unit is connected in parallel to the elastic means to preadjust the value of the predetermined tension comprising a movable portion engaging the connection portion between elastic means and adjustment unit and a force exerting element being attached at said movable portion. The mechanic adjustment unit is in an unstable equilibrium position at said predetermined tension or position, the movement of the movable portion being such that the force exerting element adds an adjustment or compensation force upon deviation of the predetermined tension or position of the elastic means.

9 Claims, 5 Drawing Sheets

DEVICE FOR ADJUSTING THE PRESTRESS OF AN ELASTIC MEANS AROUND A PREDETERMINED TENSION OR POSITION

BACKGROUND OF THE INVENTION

1) Field of the Invention

The present invention relates to a device for adjusting the prestress of an elastic means, especially the prestress of a spring used to adjust height of and the relief force acting on a weight, especially on the weight of a patient within a locomotion training means to be used for walking therapy of paraparetic or hemiparetic patients. In other words, the invention relates generally to an automatic adjusting device for the prestress deviation of a spring in an operating point and especially to an automatic unloading device that allows unloading an object attached to one end of a rope by a precise counter force. Especially, the invention relates to a device and a process which can be used within a locomotion training of patients with walking impairments in any phase of rehabilitation.

2) Description of Related Art

As mentioned above said type of unloading system can be used for different applications but is preferably intended for the use in body weight supported treadmill training. This type of training is for example being used to train neurologically impaired patients to walk again during rehabilitation. For such incomplete paraplegic patients the possibility exists of improving walking ability up to normality by means of adequate locomotion training. The required therapy at present takes place on a treadmill, where walking is first made possible for the patient by defined weight relief and partially by additional assisting guidance of the legs by physiotherapists (Wickelgren, I. Teaching the spinal cord to walk. Science, 1998, 279, 319-321).

In the rehabilitation of patients with limited motion of the legs or after orthopedic operations, various driven orthoses are already in use which actively move the legs of recumbent patients. During body weight supported treadmill training, a patient is walking on a treadmill, while he is partially suspended from part of his body weight.

EP 1 137 378 discloses an automatic machine which is used in treadmill therapy (walking therapy) of paraparetic and hemiparetic patients and which automatically guides the legs on the treadmill. Said machine consists of a driven and controlled orthotic device which guides the legs in a physiological pattern of movement, a treadmill and a relief mechanism. The knee and hip joints of the orthotic device are each provided with a drive. Said orthotic device is stabilized on a treadmill with stabilizing means in such a manner that the patient does not have to keep his/her equilibrium. The orthotic device can be adjusted in height and can be adapted to different patients.

The unloading is achieved by a counterweight that is attached to the other end of a rope, which is connected to the patient by a harness. This is by definition a simple method and the results are often acceptable for regular treadmill training. However, there are some disadvantages in using this method for this kind of therapy. One disadvantage is occurring if the patient has to be suspended by a large amount of his body weight. If a large mass has to be attached on the other side of the rope the inertia of the mass is causing large forces during the up and down acceleration of the body. Also, it is not very easy to change the amount of unloading during the training with most of the conventional counterweight systems. Either the therapist has to lift weight to or from the system to change the suspension or the patient has to be lifted by a winch to be able to connect additional counterweights to the system.

U.S. Pat. No. 5,273,502 discloses a device using two different cable length adjustment means to provide a reliable positioning of the device height. Another limitation of this approach is furthermore the limited liberty of changes to be made in the course of the application of the walking program for the patient.

The not prepublished EP 1 586 291 from the applicant shows a solution for the adjustment problem through use of an electronic control device. However, it is a demand of the market to equip such a device with a less costly control device.

Since the relief force is achieved through use of a spring means, one object of the invention is therefore to describe a simpler device and a process for adjusting the change in prestress around an operating point of a spring.

One further object of the invention is to describe a device allowing quick response times and precise determination of the height of the patient's position and of the relief force through simpler, i.e. less complex, means.

It is an further object of the invention to realize a mechanism wherein an elastic means having a linear or non-linear path-dependent or stroke-dependent force progression nevertheless provides an almost constant force within a given motion range or stroke.

U.S. Pat. No. 5,273,502 discloses a winch as a principal cable length adjustment means. This adjustment means always acts on the same length of cable providing different aging effects on wound and unwound parts of said cable and asks for a strong motor to achieve the necessary counter force for a person to be lifted.

It is a further object of the invention to describe a device allowing better adjustment of the height of a patient's position and improved aging properties of the corresponding cable.

SUMMARY OF THE INVENTION

The present invention relates on the insight that the functions of the spring adjustment has preferably to be achieved through mechanical means thus avoiding more complicated control devices.

This object is met in accordance with the invention by means of a device as described herein.

A device for adjusting the prestress of an elastic means around a predetermined tension allows for the compensation of the variation of the elastic means force, especially, if said elastic means is a spring. The invention provides a solution for the problem upon use of springs a change of the position of the supported weight or similar forces, the spring constant being directly connected to the elongation of the spring, changes the spring force. The invention allows now to achieve a nearly constant spring force and the at least partial compensation of this effect through use of a mechanic adjustment unit which is connected in parallel to said elastic means. This allows for a pre-adjustment of the value of the predetermined tension over a movement range. The mechanic adjustment unit comprises a movable portion engaging the connection portion between elastic means and adjustment unit and a force exerting means being attached at said movable portion, wherein the mechanic adjustment unit is in an instable equilibrium position at said predetermined tension and position, the movement of the movable portion being such that the force exerting means adds an adjustment force upon deviation of the predetermined tension or position of the elastic means.

Such a mechanic adjustment unit compensates for force changes corresponding to length changes of the spring and allows for a predictable change of the force acting on an attached item.

Such a force exerting means can create a torque through a spring attached to a knee lever but it is also possible to attach a weight at said attachment point of the knee lever. It is only important that a force is exerted which is increasing from an initial value, preferably 0, if the movable portion follows a deviation of the connecting portion.

The use of a further motor can be avoided, if the winch means known from the prior art is replaced through the device according to the invention.

When applied to a locomotion therapy apparatus the features according to the invention uses two different cable length adjustment means. One is provided to adjust the length of the cable to define the height of the suspended weight. The other is provided to adjust the length of the cable to define the relief force acting on the suspended weight.

The invention enhances the control of height and relief force through the separation of the functions. The height of the weight depends on the patient, whether he is a tall or a small person. This is adjusted at the beginning of a training session. The corresponding device can act slowly, even manually. Therefore the device according to the invention achieves the slow change of the cable length avoiding winding up cable length and allowing for a distributed tension distribution on the whole cable.

The relief force has to be controlled during the actual therapy. The second cable length adjustment means divides the necessary relief force in a first static part, providing an approximate force response, and a second dynamic part, providing the fast fluctuations of the relief force while the patient is walking.

Further preferred embodiments of the apparatus according to the invention are characterized in the dependent claims.

In order to adapt the principles of the invention to a larger range of instruments the different devices can be motorized and can be connected to a computer means with memory, the memory comprising database entries for different patients (height of suspension and intended general relief force) and different walking therapies (fine tuned relief force programs). This allows a quick and reliable determination and adjustment of the height for different patients and of the relief force within the training program of every patient.

A benefit of the device according to the invention is therefore that any patient can readily mount the apparatus to use the treadmill therapy, which is very easy to adjust for his needs. No special preparation of the treadmill, and no dedicated elastic means are required.

DETAILED DESCRIPTION OF THE INVENTION

Figure 1:
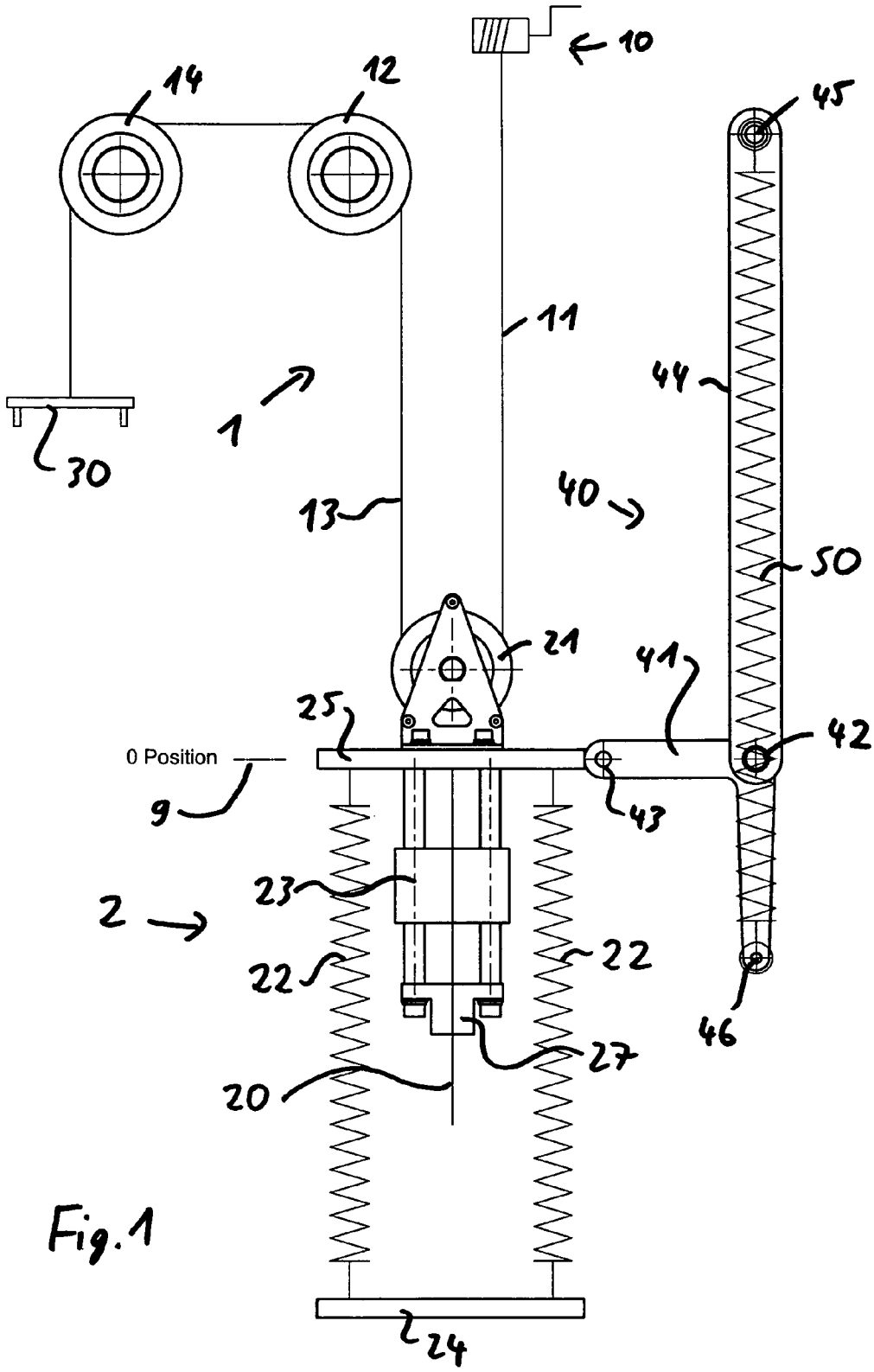
FIG. 1 shows a schematic side view of a device according to a first embodiment of the invention in a middle position.

FIG. 1 shows a schematic perspective view of a device for adjusting the prestress of a spring according to an embodiment of the invention.

The device is shown within the application in an apparatus for the control of height of and relief force acting on a weight. Such an apparatus comprises two main components: one static part 1 and another dynamic part 2. The static component 1 comprises a lifting means 10, here schematically shown as a winch 10 but preferably replaced by an unit according to FIG. 7 controlling a primary cable 11 to which the weight is attached. In the embodiment shown the primary cable 11 fixed at the turning sleeve of the winch 10 is running preferably parallel to the longitudinal main axis 20 of the dynamic part 2 of the device. Said longitudinal main axis 20 is usually directed vertically to the ground.

Cable 11 engages the moving roller 21 being part of said dynamic part 2 and leaves the dynamic part 2 as adjusted cable portion 13 of the cable 11. The cable 11 is then leaving the device redirected by one or more fixed rollers 12 and 14; the corresponding prolongation of the cable 11 ends in a weight harness with the reference numeral 30.

A patient who intends to use a known apparatus for a treadmill therapy, e.g. according to EP 1 137 378, is attached in said prolongation of the cable 11 in a harness (not shown) oriented vertically. The winch 10 is statically suspending the patient so he can not fall and therefore is also responsible for the safety of the patient per se.

The dynamic part 2 comprises several elastic means 22. The elastic means of the embodiment of FIG. 1 is a spring means provided as two helicoidal springs provided on either side of a central guiding sleeve 23. Beside the use of helicoidal springs 22 it is also possible to use different types of elastic means, being able to exert a force in the approximate range of the intended weight to be attached to the prolongation 30 of the cable 11.

Springs 22 are attached between a bottom plate 24 and a top plate 25 forming a connection portion as explained below. The bottom plate 24 can be fixed to a rack or can be displaced in direction of the longitudinal axis 20 to fix an initial elongation. Top plate 25 is connected to the pulley 21, pulling the cable 11 down. Through use of the redirection of cable portion 13 the rollers 12, 14 and 21 have the function of a pulley-block. It can be intended to use even more redirections to translate the adjustment of the cable length of the prolongation 30 into a much smaller movement of the pulley 21.

FIG. 1 shows the device in a so called 0 position, shown by the horizontal line with the reference numeral 9.

Top plate 25 is connected with a mechanic adjustment unit 40 having a movable portion. In this embodiment said movable portion comprises a knee lever 41. The knee lever 41 is articulated at the middle 42 of the knee with the lower end of a rod 44 being fixedly attached at its upper end 45. One end of the knee lever 41 is pivotably attached at the top plate 25 at point 43. It can be seen that the connecting point 42 is in the 0 position at the height of the top plate 25. It is preferable to change the initial load on the springs 22, here through repositioning of the plate 24, to guarantee an initial middle position at height 9, i.e. the height of the connecting point 42. A force exerting element 50 is attached between attachment point 45 and the other end 46 of the knee lever 41. This force exerting element 50 can be realized through a further spring as shon in the drawing.

Figure 3:
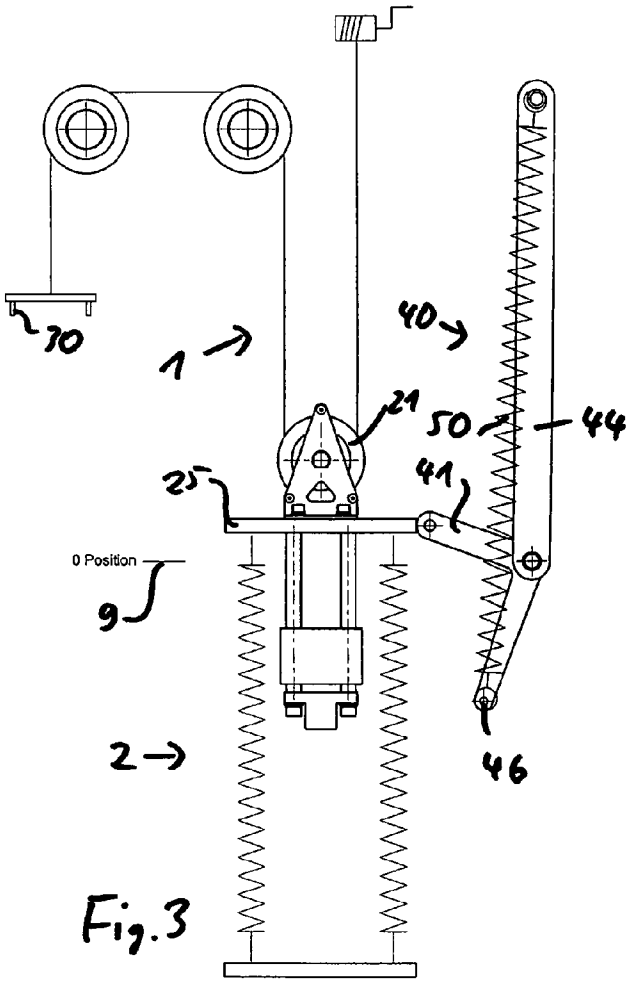
FIG. 3 shows a schematic side view of a device according to FIG. 1 in a position where the weight is lowered.
Figure 2:
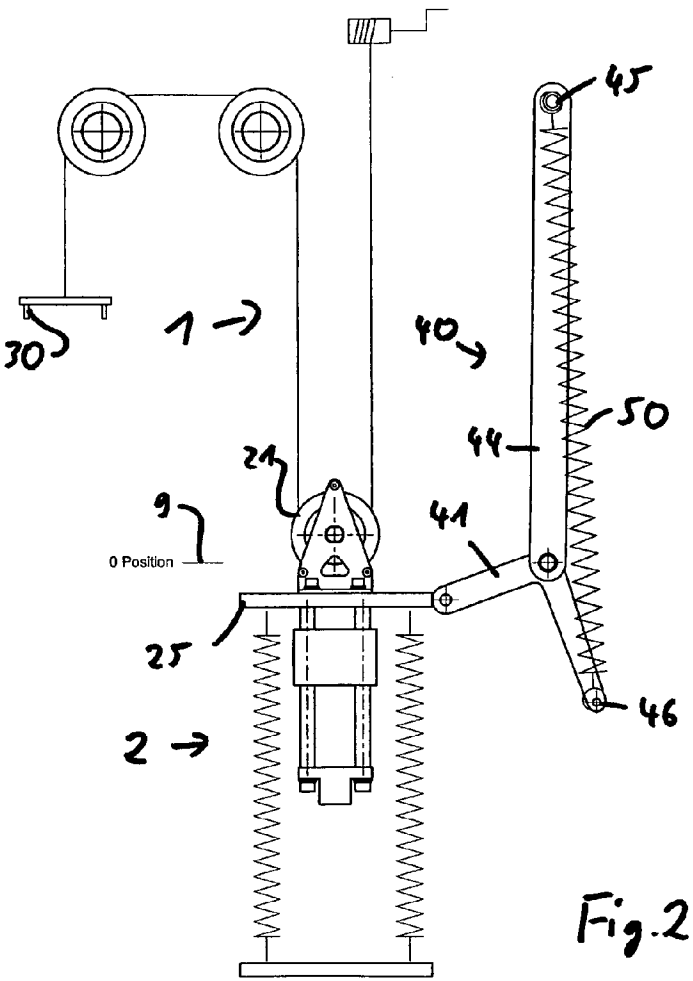
FIG. 2 shows a schematic side view of the device according to FIG. 1 in a position where the weight is lifted.

This allows directly using said additional spring to maintain the intended spring load around the operating point in FIG. 1 and FIGS. 2 and 3. Same features receive the same reference numerals.

Within an application of the device in a treadmill training, a neurologically impaired patient, attached to the other side 30 of the cable 11 with a harness, would be suspended over the walking surface by the winch 10 (static unloading system 1) until standing. The amount of unloading is defined by the control unit. A small motor attached to the plate 24 would then extend the springs 22 up to a length that more or less corresponds to the desired unloading of the patient. Like this the dynamic system is already unloading the patient with the desired force.

The up and down movement of the patient causes the force to be not constant during the training. Therefore the mechanic adjustment unit 40 will adjust the force change of pulley 21 because of the dynamic movement of 25 during patient training according to the mechanical constraints, so the force acting on the rope 11 will be nearly constant independent from the position of the load or patient within a given range and thus the patient experience the same relief during the whole training in comparison to the force at the middle position FIG. 2 shows the action of the mechanic adjustment unit 40 in case that the weight attached at 30 is lifted. The relief force is reduced through the shortening of the springs 22. Additionally there is a deviation of further spring 50 from the equilibrium position, creating a torque through said spring 50 given by the distance of 42 from the spring 50. The most important effect is the deviation from the unstable equilibrium position, the additional spring 50 urging the point 46 to deviate even further from the position shown in FIG. 1, thus increasing the force urging the plate 25 via knee lever 41 away from the 0 position 9, thus countering the effect of the reduction of the relief force through reduction of length of springs 22.

FIG. 3 shows the action of the mechanic adjustment unit 40 in case that the weight attached at 30 is lowered. The relief force is increased through the extension of the springs 22. This effect is boosted through the deviation of further spring 50, the distance between point 42 and the spring being reduced through pivotal of the knee lever (and in smaller extent to the deviation of rod 44 to the opposite side of attachment point 46).

The two effects combine conducting to a faster redress of the balance situation. The use of the instable equilibrium position of the mechanic adjusting unit 40 improves this behaviour.

When the device is used within walking training of patients, the person is attached in the equilibrium position using the device 10 with the intended relief force applied through movement and fixation of plate 24 at the predetermined place. The patient is then walking wherein the patient's vertical position usually uses a range between minus 5 and plus 2 centimeters. This means that the patient is usually lifting his feet during walking and is therefore taller by a larger amount than the reduction of his height over the 0 position. The range of an embodiment of the invention to be used for such walking training uses the guiding sleeve 23 in connection with the plate 25 and the opposite plate 27 as stops to limit the movement range of the spring. The embodiment uses a range between minus 65 and plus 45 millimeters.

The springs 22 used have a spring constant of 5.3 N/mm and are intended to give the patient a relief of about 20 kg of his weight. The change of the length of spring 22 to plus or minus 35 millimeter therefore gives a change of the force of spring 22 of up to 185.5 Newton.

The additional spring 50 according to FIG. 1 has a spring constant of around 3 N/m. The length of said spring 50 is only changing according to a cosinus function around 0, i.e. following $1-(x^2/2)$, if the norm force is 1. The force is around 566 N at the equilibrium position and 550 N at a deviation of 35 millimeters. Through application of the lever, a momentum is created, which starts from 0 at equilibrium position up to 177 N at 35 millimeters. Therefore the embodiment according to the invention is able to compensate almost the entire deviation of the force but 8.5 Newton. If a longer spring 50 would be chosen and a longer lever relationship, than a higher compensation can be reached depending on the actual choices.

Figure 7:
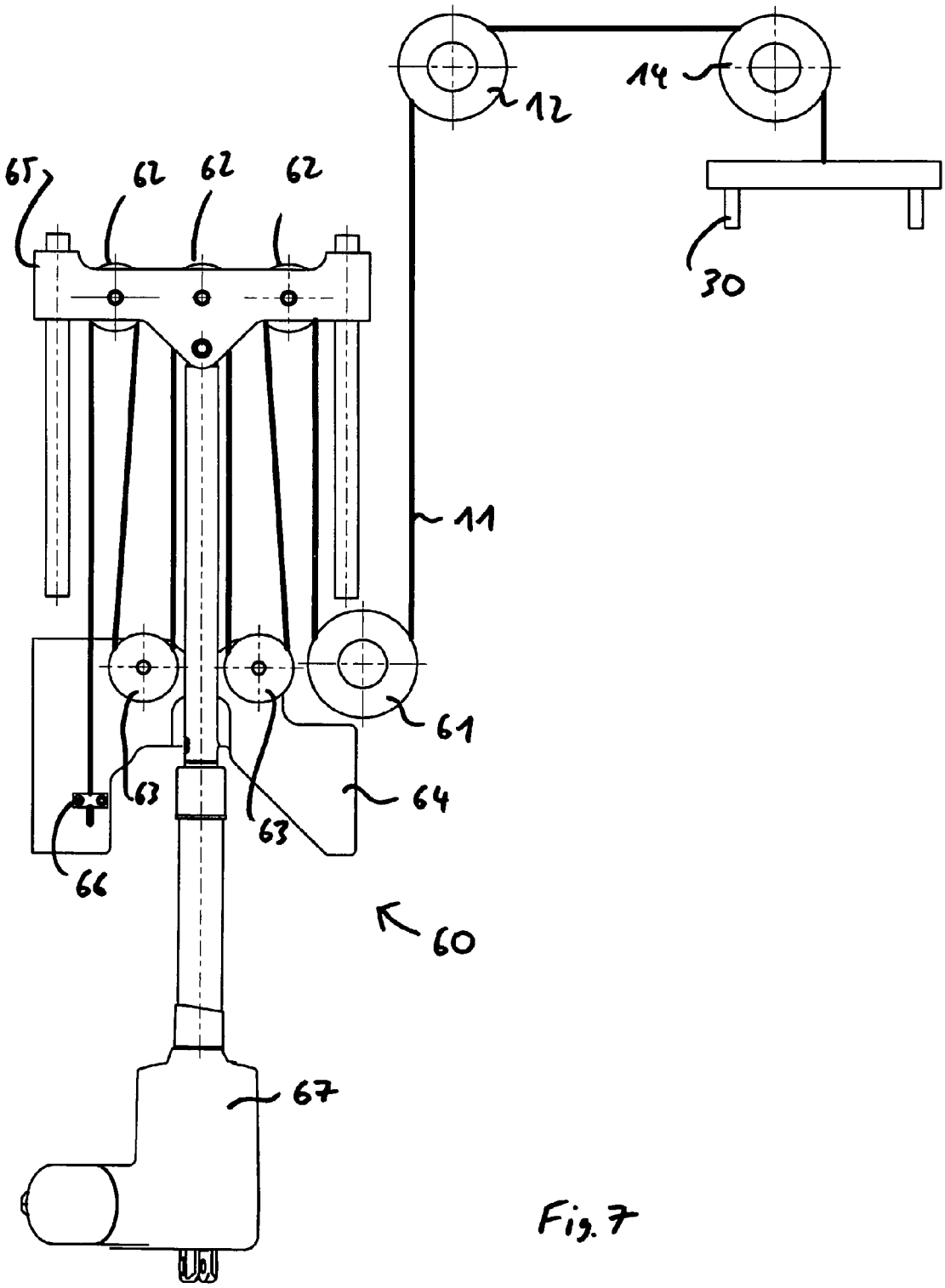
FIG. 7 shows a schematic side view of a device according to another embodiment of the invention.

It is possible to provide a computerized control means in the sense, that the position of the plate 24 defining the relief force and the position of the cable on the winch 10 or plate 65 according to FIG. 7 defining the height of the patient are stored and automatically applied to drives for these two control elements.

Figure 4:
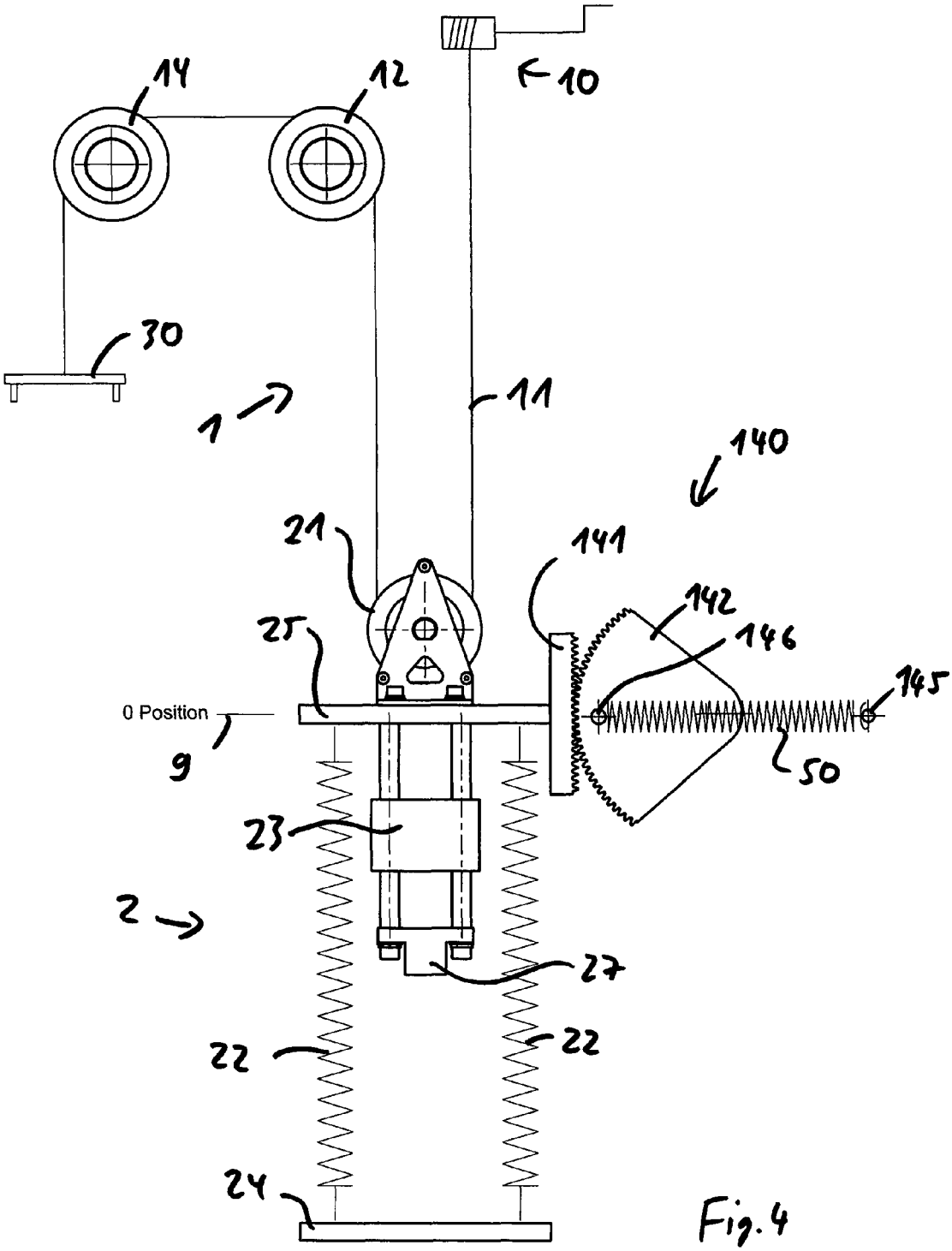
FIG. 4 shows a schematic side view of a device according to a second embodiment of the invention in a middle position.

FIG. 4 shows a schematic perspective view of a device for adjusting the prestress of a spring according to another embodiment of the invention. All identical and similar features receive the same numerals.

The static part 1 and the dynamic part 2 in relation to the mounting of the springs 22 are identical to the first embodiment. The difference relies in the mechanic adjustment unit 140 having a different movable portion. In this embodiment said movable portion comprises a vertical ratchet 141, being in engagement with a cogwheel 142. Preferably cog-wheel 142 is only part of a wheel, covering only e.g. 90 degrees, since the vertical movement of the ratchet 141 will only allow a movement of the cogwheel of about plus/minus 45 degrees. At the height of the null position 9, a further spring 50 is attached at point 145 in the prolongation of the cogwheel 142. The further spring 50 is additionally attached near the outer circumference of the cogwheel at the height of null position 9 (in the middle position of FIG. 4).

Figure 6:
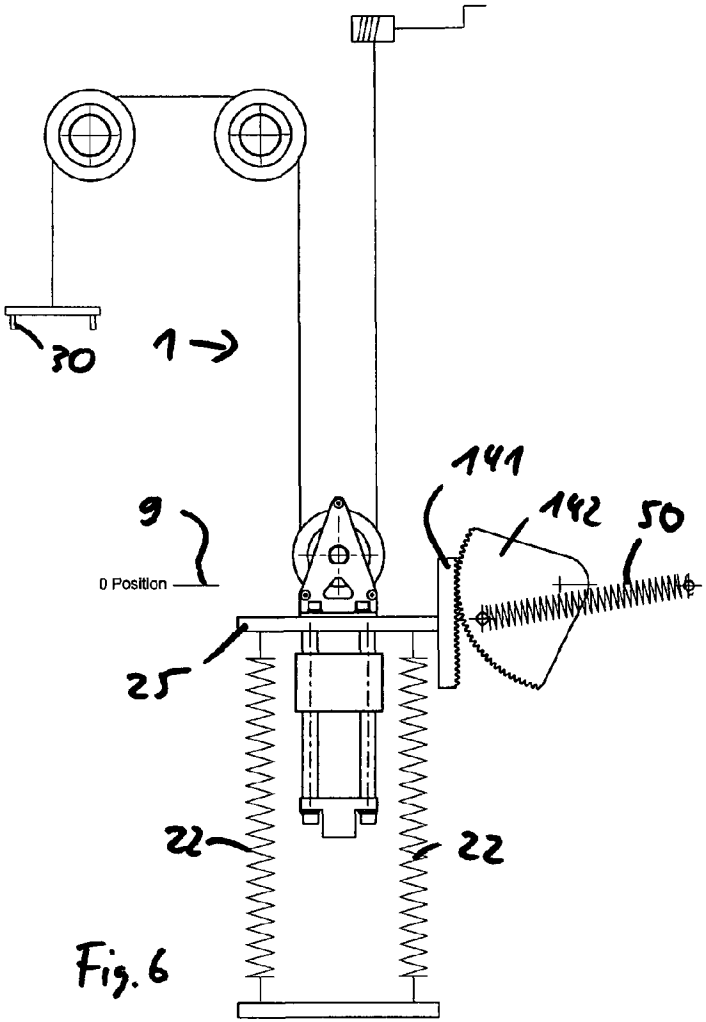
FIG. 6 shows a schematic side view of a device according to FIG. 4 in a position where the weight is lifted.
Figure 5:
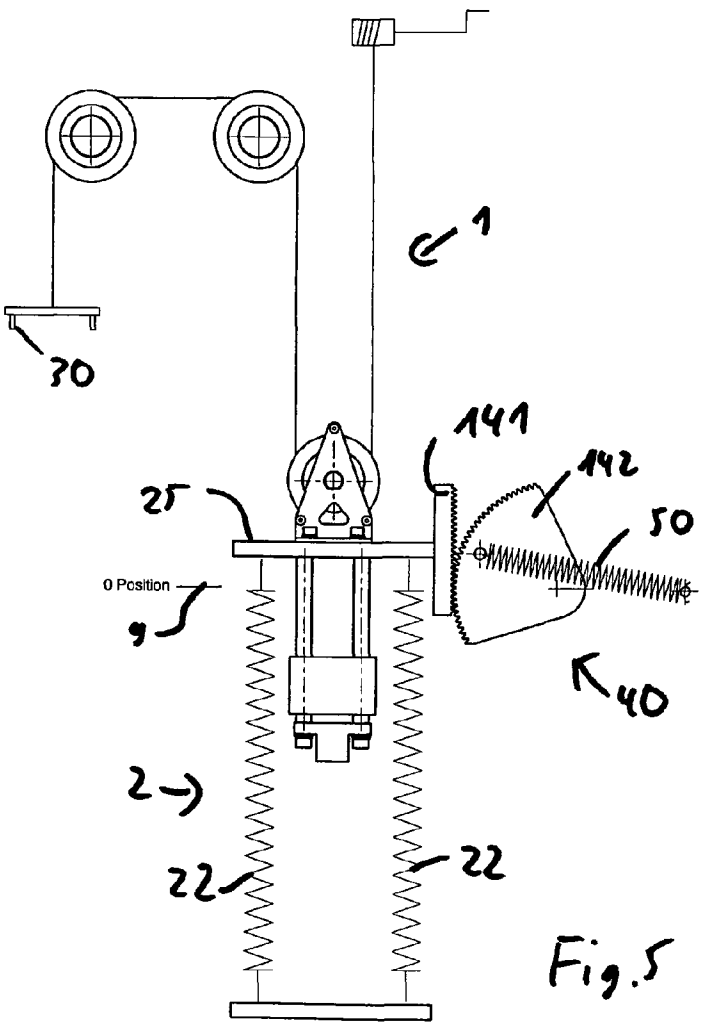
FIG. 5 shows a schematic side view of the device according to FIG. 4 in a position where the weight is lowered.

FIG. 5 and FIG. 6 show the action of the device according to the second embodiment, showing that there are several possibilities to attach an additional spring means 50 to achieve the additional force as described in connection with the first embodiment. This means that, if the weight is lowered as shown in FIG. 5, the rotation of cogwheel 142 provide for a deviation of further spring 50 from the equilibrium position. Due to the fact that the rotating axis of the cogwheel 142 is between the two mounting points 146 and 15 the rotation of the cogwheel 142 is supported by the spring 50 thus increasing the force exerted by said spring on the cogwheel 142 and the ratchet 141 and thus further increasing the relief force.

FIG. 6 shows the lifting of the weight with the corresponding shortening of the springs 22 and the reduction of relief force. This reduction is lessened through the deviation of additional spring 50 upon rotation of the cogwheel 142 in the opposite direction in comparison to FIG. 5, the effect of increasing force exerted by the mechanic adjustment unit 40 being the same.

The invention is based on the insight that the provision of two separate spring forces allow for a preferable behaviour of the dynamic device around the average position. An increase of the weight tensions the springs 22 and increases the relief or counter force. This effect is even more increased through provision of the additional spring 50 which has an instable equilibrium position at the middle position, and which spring 50 is deviated from the balance or equilibrium situation thus exerting a positive (pushing) force onto the plate 25, countering the effect of Hooke's law upon relief of a weight and increasing the effect when a higher weight force is applied. This reduces—in practical applications—the variations of the support of a weight considerably, e.g. from 10% to under 1% or even better depending on the choices made by someone skilled in the art.

In another embodiment not shown in the drawings the force exerting element 50 comprises a drive. Said drive is connected to the mechanic adjustment unit for a movement of the movable portion engaging the connection portion 25. Said drive can comprise a shaft which is oriented in parallel to springs 22 and engages the plate 25 for a movement of said plate in the longitudinal direction of the springs 22. The drive is connected to a control unit controlling the drive in a way that the drive adds an adjustment or compensation force upon deviation of the predetermined tension or position of the elastic means 22. In other words, the drive is controlled to apply a force to the movable portion, which is predetermined depending on the position of said movable portion. The drive replaces the spring 50 in view of FIG. 1 or 4 showing other embodiments of the invention. It is therefore possible to predetermine the necessary control parameters for the drive beforehand, i.e. calibrating it based on the position of the mecanic unit.

Although within the embodiment according to FIG. 1 to 6 a winch 10 is schematically shown, it is preferred using within this application but also in other technical fields a chain block or pulley 60 according to FIG. 7. The weight to be suspended is located at an attaching point 30. Cable 11 is redirected through e.g. rollers 12 and 14 to the chain-block 60. Starting from the entry roller 61, the cable 11 is redirected a number of times, at least once, through moving rollers 62 attached to a movable support 65 and fixed rollers 63 attached to a fixed support 64. The cable 11 is finally attached at point 66 to the fixed support, although it might also be attached to the movable support 65. Any adjustment of the length of cable 11 is provided through a drive 67 attached at the fixed support 67 driving a spindle, increasing or reducing the distance between the two supports 64 and 65. The important insight of the invention is the use of such a pulley and tackle system avoiding an asymmetrical handling of the cable 11 which is automatically applied to any cable, if it is wound on a cylinder as it is done, if a winch system is used. Beside to deteriorating effects on the cable due to winding up a cable over time, one advantage of this proposal is the identical free length of the cable under all operating conditions, since the cable is always stretched between points 30 and 66 and is only redirected through e.g. rollers.

The invention claimed is:

1. A device for adjusting the prestress of one or more elastic elements around a predetermined tension or position, comprising:

a connection portion being connected with the one or more elastic elements, a mechanic adjustment unit being connected with the connection portion for a connection in parallel with the one or more elastic elements to preadjust a value of the predetermined tension; wherein said mechanic adjustment unit comprises:

a movable portion engaging the connection portion, where the connection portion is located between the one or more elastic elements and the mechanic adjustment unit, and a force exerting element being attached at said movable portion;

wherein the mechanic adjustment unit is in an unstable equilibrium position at said predetermined tension or position, a movement of the movable portion being such that the force exerting element adds an adjustment or compensation force upon deviation of the predetermined tension or position of the one or more elastic elements;

wherein the force exerting element is a torque exerting element, and wherein the torque exerting element comprises a further elastic element having two end portions, wherein the further elastic element is attached with one end portion at said movable portion, another end portion of the further elastic element being fixedly attached.

2. The device according to claim 1, wherein the movable portion of the mechanic adjustment unit is a knee lever pivotably attached at the connection portion.

3. The device according to claim 1, wherein the movable portion of the mechanic adjustment unit is a cogwheel portion engaging a ratchet fixedly attached at the connection portion.

4. The device according to claim 1, wherein the elastic element comprises at least one of a tension spring or a pressure spring.

5. The device according to claim 1, wherein the device adjusts the prestress of the one or more elastic elements used to adjust a height of a weight and a relief force acting on the weight.

6. An apparatus for adjusting a height of a suspended weight and a relief force acting on the suspended weight, comprising:

a cable supporting said weight;

a first cable length adjustment means to provide an adjustment of the length of the cable to define the height of said suspended weight;

a second cable length adjustment means to provide an adjustment of the length of the cable to define the relief force acting on the suspended weight;

wherein the second cable length adjustment means comprises one or more elastic elements to provide a counter force to the suspended weight creating a predetermined tension and position of said one or more elastic elements;

further comprising a device for adjusting the prestress of said one or more elastic elements around said predetermined tension or position, comprising:

a connection portion being connected with the one or more elastic elements, a mechanic adjustment unit being connected with the connection portion for a connection in parallel with the one or more elastic elements to preadjust a value of the predetermined tension;

wherein said mechanic adjustment unit comprises:

a movable portion engaging the connection portion, wherein the connection portion is located between the one or more elastic elements and the mechanic adjustment unit, and a force exerting element being attached at said movable portion;

wherein the mechanic adjustment unit is in an unstable equilibrium position at said predetermined tension or position, a movement of the movable portion being such that the force exerting element adds an adjustment or compensation force upon deviation of the predetermined tension or position of the one or more elastic elements;

wherein the force exerting element is a torque exerting element, and wherein the torque exerting element comprises a further elastic element having two end portions, wherein the further elastic element is attached with one end portion at said movable portion, another end portion of the further elastic element being fixedly attached.

7. The apparatus according to claim 6, wherein said first cable length adjustment means comprises an attachment point for an end of the cable, wherein the cable is redirected by at least one movable roller, wherein a drive unit is provided to displace said movable roller in relation to at least one fixed roller.

8. The apparatus according to claim 7, wherein the attachment point is provided in a rigid relationship to the at least one fixed roller.

9. The apparatus according to claim 6, wherein the apparatus adjusts the height of the suspended weight and the relief force acting on the suspended weight within a locomotion training means to be used for walking therapy of paraparetic or hemiparetic patients.

* * * * *